US008977502B2

(12) United States Patent
Liu

(10) Patent No.: US 8,977,502 B2
(45) Date of Patent: Mar. 10, 2015

(54) PREDICTING STEAM ASSISTED GRAVITY DRAINAGE STEAM CHAMBER FRONT VELOCITY AND LOCATION

(71) Applicant: Conocophillips Company, Houston, TX (US)

(72) Inventor: Yongnuan Liu, Calgary (CA)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 13/857,303

(22) Filed: Apr. 5, 2013

(65) Prior Publication Data

US 2013/0277049 A1 Oct. 24, 2013

Related U.S. Application Data

(60) Provisional application No. 61/637,652, filed on Apr. 24, 2012.

(51) Int. Cl.
*G01V 1/40* (2006.01)
*E21B 43/24* (2006.01)

(52) U.S. Cl.
CPC ..... *E21B 43/2406* (2013.01)
USPC ..... 702/13

(58) Field of Classification Search
None
See application file for complete search history.

(56) References Cited

U.S. PATENT DOCUMENTS

| | | | | |
|---|---|---|---|---|
| 7,036,853 | B2 * | 5/2006 | Smock et al. | 292/109 |
| 7,486,070 | B2 | 2/2009 | Madio et al. | |
| 2010/0258265 | A1 * | 10/2010 | Karanikas et al. | 165/45 |
| 2010/0288490 | A1 | 11/2010 | Nukhaev et al. | |

FOREIGN PATENT DOCUMENTS

| | | |
|---|---|---|
| CN | 101476458 | 12/2010 |
| WO | 2011025591 | 3/2011 |

OTHER PUBLICATIONS

Aherne and Birrell, "Observations Relating to Non-Condensable Gasses in a Vapour Chamber: Phase B of the Dover Project" SPE International Thermal Operations and Heavy Oil Symposium and International Horizontal Well Technology Conference, Nov. 4-7, 2002, Calgary, Alberta, Canada (2002).

Aherne and Maini "Fluid Movement in the SAGD Process: A Review of the Dover Project", Petroleum Society's 7th Canadian International Petroleum Conference (57th Annual Technical Meeting), Calgary, Alberta, Canada, Jun. 13-15, (2006).

Aherne and Maini, "Fluid Movement in the SAGD Process: A Review of the Dover Project", , J. Canadian Petroleum Tech. 47 (2008).

(Continued)

*Primary Examiner* — Aditya Bhat
(74) *Attorney, Agent, or Firm* — ConocoPhillips Company

(57) ABSTRACT

The invention relates to the development of an analytical model to predict the velocity of the continuously expanding front of the steam chamber in a steam assisted gravity drainage (SAGD) hydrocarbon production system. The developed analytical model has advantages over reservoir simulation tool in that it is very fast and can be easily calibrated with field observation well data before making good prediction. One field study shows that the developed model can achieve excellent prediction for a field SAGD performance. A better understanding of the size of the steam chamber and the velocity of the front should provide better time, cost and energy efficiency for the production of high viscosity hydrocarbons.

7 Claims, 6 Drawing Sheets

(56) References Cited

OTHER PUBLICATIONS

Al-Bahlani and Babadagli, "SAGD laboratory experimental and numerical simulation studies: A review of current status and future issues." J. Petroleum Science Eng. 68:135-50 (2009).

Butler and Mokrys, "Solvent Analog Model of Steam-Assisted Gravity Drainage." AOSTRA J. Res. 5:17-32 (1989).

Chen, et al., "Effects of Reservoir Heterogeneities on the Steam-Assisted Gravity-Drainage Process." SPE Reservoir Evaluation & Engineering, 11: 921-32.

* cited by examiner

PREDICTING STEAM ASSISTED GRAVITY DRAINAGE STEAM CHAMBER FRONT VELOCITY AND LOCATION

CROSS-REFERENCE TO RELATED APPLICATIONS

This application is a non-provisional application which claims benefit under 35 USC §119(e) to U.S. Provisional Application Ser. No. 61/637,652 filed Apr. 24, 2012, entitled "PREDICTING STEAM ASSISTED GRAVITY DRAINAGE STEAM CHAMBER FRONT VELOCITY AND LOCATION," which is incorporated herein in its entirety.

STATEMENT REGARDING FEDERALLY SPONSORED RESEARCH OR DEVELOPMENT

None.

FIELD OF THE INVENTION

This invention relates to managing and optimizing a process for producing heavy hydrocarbons called Steam Assisted Gravity Drainage where steam is injected into a first generally horizontal steam injector pipe to heat high viscosity hydrocarbons to a temperature that lowers the viscosity for the hydrocarbons to flow to a production pipe.

BACKGROUND OF THE INVENTION

SAGD (Steam Assisted Gravity Drainage) is a proven effective commercial process to recover heavy oil and oil sands and has been widely used in Canadian Oil sands recovery. As shown in FIGS. 1 and 2, the SAGD process creates a steam chamber 10 under the ground G in a hydrocarbon formation B around a generally horizontal steam injection pipe 12 where steam is injected into the steam chamber 10 and heats and reduces the viscosity of oil in the area to produce the oil from a production pipe 14 that is arranged below the steam injection pipe 12. The process is operated over an extended period of time while the steam chamber 10 continuously expands. Predicting the velocity of the expanding SAGD stream chamber 10 or more specifically, the velocity of the front 20 of the SAGD steam chamber plays a critical role in the interpretation and prediction of performance of SAGD process and the management and operation of a SAGD production system. The faster the front 20 moves and the bigger the steam chamber 10 expands results in a higher oil production rate and the larger the total recovery of oil from the SAGD system.

At present, four dimensional (4D) seismic interpretation data can only dynamically map surfaces that have a temperature of 60 degrees C. which is much lower than the steam saturation temperature. So the portion of the formation mapped by the 4D seismic technique is actually quite a bit larger than the steam chamber 10 and thus, 4D seismic data will overestimate the size of steam chamber 10. Also, if the front 20 is moving or progressing slowly, the size overestimation of the steam chamber 10 is likely to be higher or magnified.

Reservoir simulation has the capability of simulating steam chamber geometry, but with an insurmountable drawback of extremely slow speed in field study with multiple pairs of SAGD wells.

It is desirable to create an analytical tool that is fast and can be easily calibrated with field observation well data to make good predictions of the location and velocity of the steam front in a SAGD production system.

BRIEF SUMMARY OF THE DISCLOSURE

The invention more particularly relates to a process for producing hydrocarbons from a steam assisted gravity drainage formation where a steam injector pipe is installed into the ground to have a generally horizontal run through a hydrocarbon bearing formation and a production pipe is installed into the ground to have a generally horizontal run through the hydrocarbon bearing formation and being arranged slightly below the steam injector pipe. Steam is delivered into the steam injector pipe to heat the hydrocarbon formation and reduce the viscosity of the hydrocarbons and travel toward the production pipe and create a steam chamber where hydrocarbons are lower viscosity or drained from the steam chamber within the hydrocarbon formation where a steam chamber front defines the boundary of the steam chamber from the high viscosity hydrocarbons that are yet to be sufficiently heated to drain from the steam chamber. The hydrocarbons are produced from the hydrocarbon formation to the surface through the production pipe wherein the rate at which the steam is delivered to the steam injector pipe is adjusted based upon a model of steam front velocity through the hydrocarbon formation assuming the shape of the steam chamber to be pseudo-radial around the steam chamber such that the steam front is located at a common distance from the steam injector pipe from about 20 degrees to about 70 degrees from the horizontal on either side of the steam injector pipe.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The theory behind the present invention was inspired by the principle embedded in classic Stefan problem, which aims to solve the phase change with moving boundary. Two typical examples of Classic Stefan problem are solidification and ice melting. However, herein the principle of Stefan problem is modified to adapt to SAGD process by including the convective heat flux and gradual change of temperature at the front of the steam chamber or at the moving interface between the steam chamber and the high viscosity bitumen in the hydrocarbon bearing formation.

Figure 1:
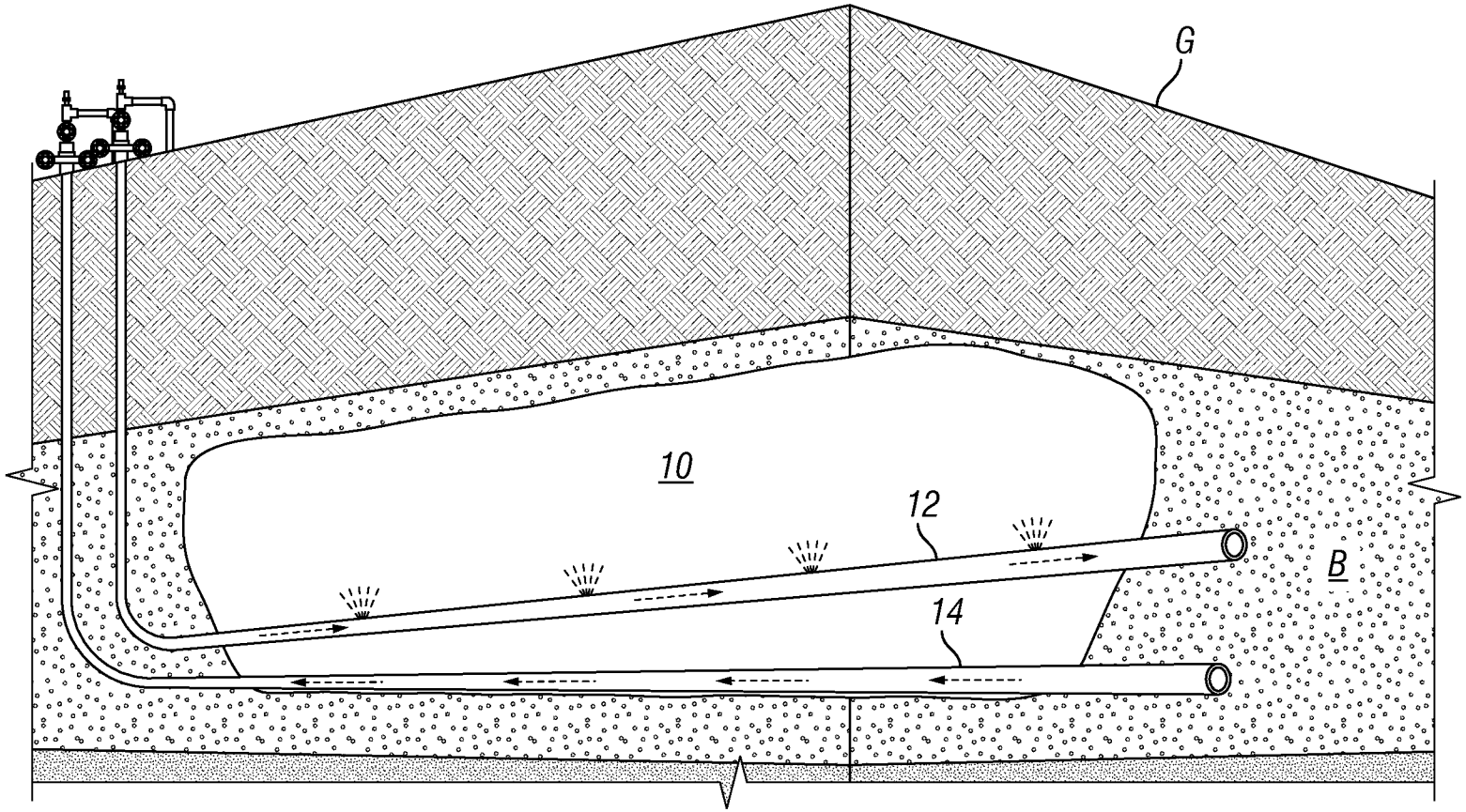
FIG. 1 (Prior Art)
FIG. 1 is a perspective view of a prior art model of steam assisted gravity drainage well showing the steam chamber within the hydrocarbon bearing formation.
Figure 2:
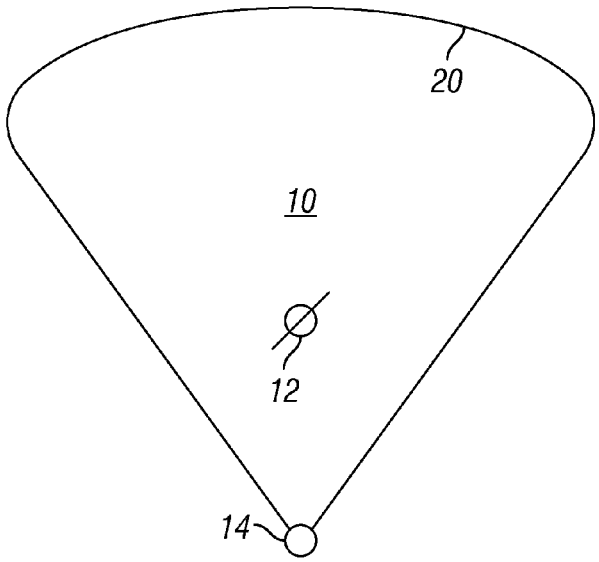
FIG. 2 (Prior Art)
FIG. 2 is a cross sectional end view of a prior art model of a steam assisted gravity drainage well.
Figure 3:
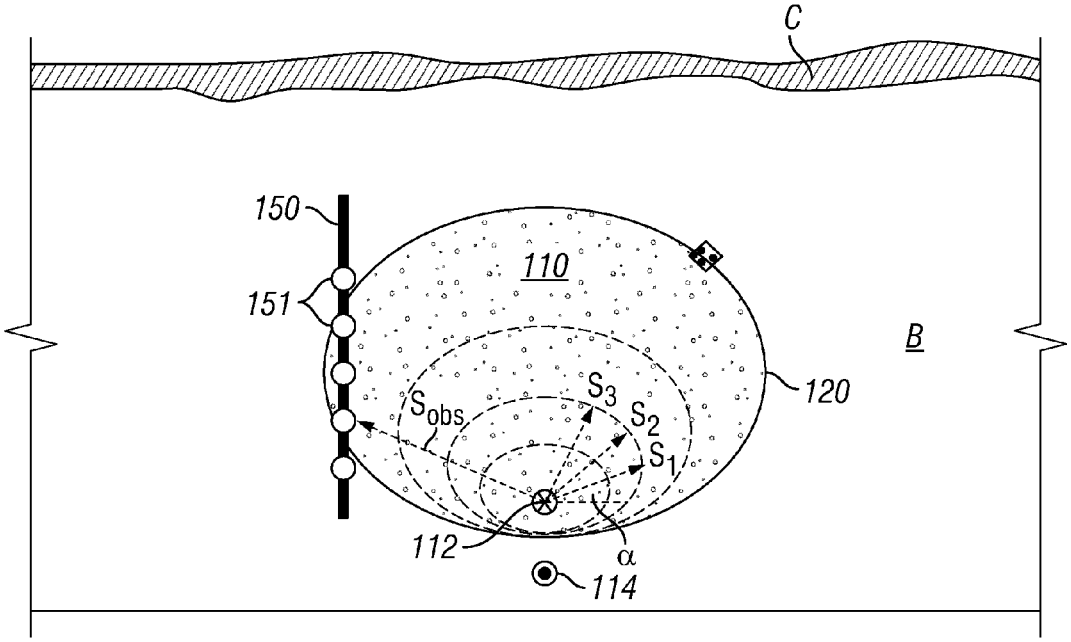
FIG. 3 is a cross sectional end view of a new interpretation of a steam assisted gravity drainage well.

Referring to FIG. 3, a schematic of a SAGD model is shown that illustrates the assumptions for the SAGD growth process. Basically, the shape of steam chamber 110 is assumed to be pseudo-radial such that the distance from the steam injector pipe 112 to the chamber boundary 120 is equal for any radius direction between about 20 degrees above the horizontal and up to about 70 degrees above the horizontal. Based on this assumption, the velocity, or rate of expansion of the chamber boundary 120, is the same in each direction for this range of direction. Thus, calculating the front moving velocity is assumed to be one-dimensional problem. This assumption regarding shape of steam chamber 110 is reasonable until the top of the steam chamber 110 reaches the caprock C. Once steam chamber 110 reaches the caprock C, the steam chamber 110 expands laterally along the underside of the caprock C. Similarly, if steam chamber 110 is redirected by an interbedded shale within the hydrocarbon formation B or netpay of bitumen and rock, the shape of the steam chamber 110 assumption becomes invalid.

Figure 4:
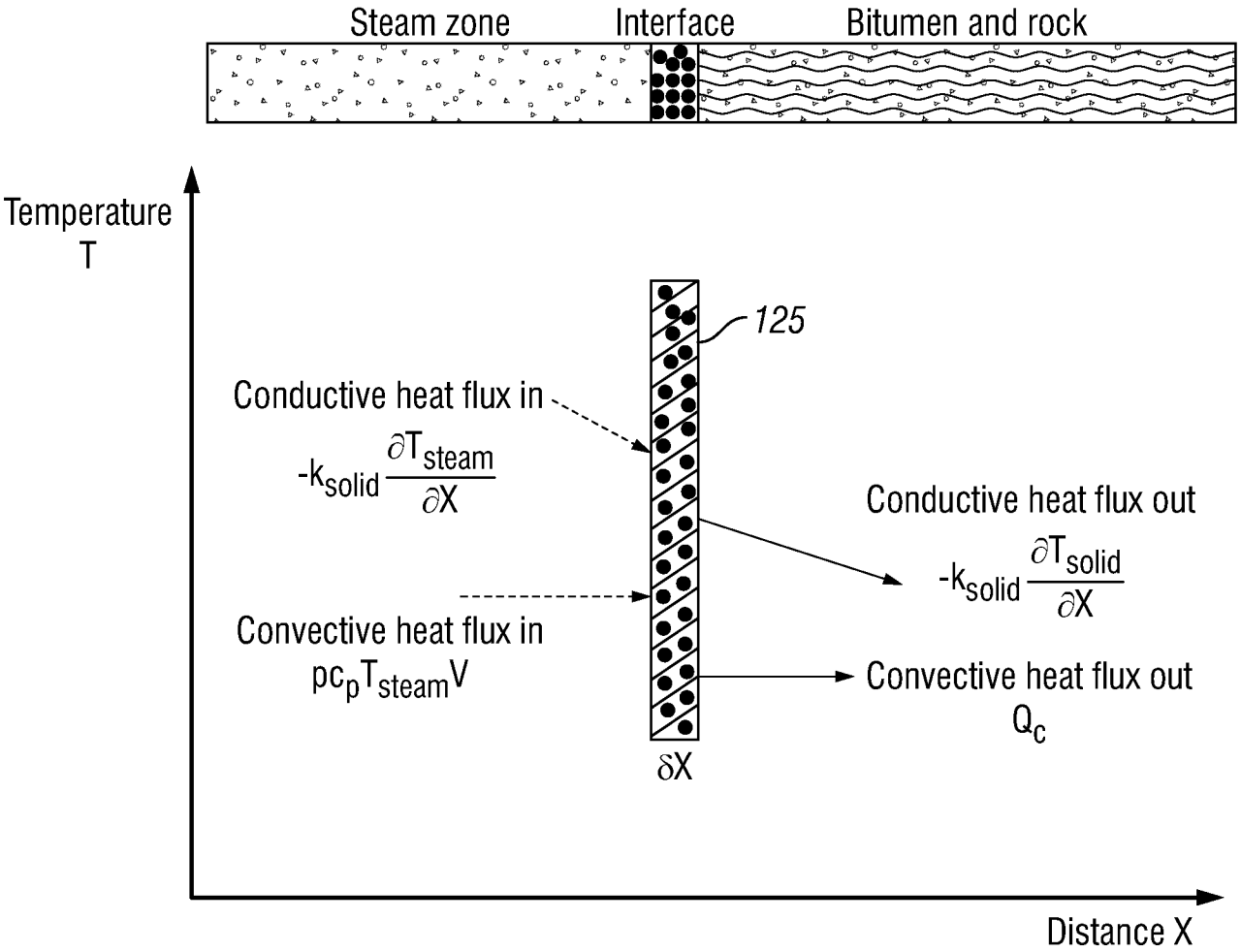
FIG. 4 is a diagram of a slice of the steam front that provides an understanding of the modeling involved in the progression of the steam front into the hydrocarbon formation.

Referring to FIG. 4, a schematic of a moving SAGD front 120 is shown as block 125 for analysis for the SAGD steam chamber. The heat balance is illustrated for block 125 moving at a rate of δX in time. In order to melt the bitumen contained per unit area within the block 125, an amount of heat LρδX is required, in which L is latent heat of condensation of steam, ρ is the density of steam, X is the thickness of the area Heat entering into the block 125 consists of convective heat flux by steam due to moving of the front and conductive heat flux due to temperature gradient.

So the heat flux entering into the shade area can be expressed as follows:

$$\left(-k_{solid}\frac{\partial T_{steam}}{\partial n}+\rho c_p T_{steam}V\right)\delta t$$

Where V is the velocity of the front or block 125; $\rho c_p$ is the volumetric heat capacity of steam; and $k_{solid}$ is the thermal conductivity of rock formation.

Similarly, heat escaping into the bitumen area from the block 125 consists of convective heat flux ahead of the front 120 and conductive heat flux due to the temperature gradient ahead of front 120. So the heat flux escaping into the bitumen area can be written as:

$$\left(-k_{solid}\frac{\partial T_{solid}}{\partial n}+Q_c\right)\delta t$$

Where $Q_c$ is the heat convection flux ahead of front 120 and $$\frac{\partial T_{solid}}{\partial n}$$

is the temperature gradient ahead of the block 125. The heat change of the block 125 due to heat influx and heat escape can be written as: $(\rho c_p)_{solid}\delta X\delta T$ where $\delta T=T_{steam}-T_{sb}$, and $T_{sb}$ refers to temperature of bitumen and rock within the block 125 before the bitumen is melted.

Therefore, the heat balance at the block 125 requires that $$\left(-k_{solid}\frac{\partial T_{steam}}{\partial n}+\rho c_p T_{steam}V\right)\delta t+L\rho\delta X-\left(-k_{solid}\frac{\partial T_{solid}}{\partial n}+Q_c\right)\delta t=(\rho c_p)_{solid}\delta X(T_{steam}-T_{sb})$$

which is referred to as Equation 1.

or $$\left(-k_{solid}\frac{\partial T_{steam}}{\partial n}+\rho c_p T_{steam}V\right)+L\rho\frac{\delta X}{\delta t}-\left(-k_{solid}\frac{\partial T_{solid}}{\partial n}+Q_c\right)=(\rho c_p)_{solid}\frac{\delta X}{\delta t}(T_{steam}-T_{sb})$$

which is referred to as Equation 2.

Since the temperature in steam chamber 120 behind the front 120 is constant, so $$\frac{\partial T_{steam}}{\partial n}=0.\ \text{And}\ \frac{\delta X}{\delta t}$$

is also equal to the velocity of moving front 120. Hence, Equation 2 can be re-written as:

$$\rho c_p T_{steam}V+L\rho V-\left(-k_{solid}\frac{\partial T_{solid}}{\partial n}+Q_c\right)=(\rho c_p)_{solid}V(T_{steam}-T_{sb}) \quad (3)$$

After rearranging, Equation 3 becomes $$[\rho c_p T_{steam}+L\rho-(\rho c_p)_{solid}(T_{steam}-T_{sb})]V=-k_{solid}\frac{\partial T_{solid}}{\partial n}+Q_c \quad (4)$$

The units in Equation 4 are as follows, $$L\left(\frac{[H]}{[M]}\right),\ \rho\left(\frac{[M]}{[L]^3}\right),\ c_p\left(\frac{[H]}{[M]\cdot[T]}\right),$$

-continued $$k_{steam}\left(\frac{[H]}{[L]\cdot[t]\cdot[T]}\right),\ V([L][t]^{-1}),\ Q_c\left(\frac{[H]}{[L]^2\cdot[t]}\right)$$

and heat unit $[H]=[M][L^2][t]^{-2}$

Known from Equation 4, there are three terms needed to be determined. They are $T_{sb}$, $$\frac{\partial T_{solid}}{\partial n}$$

and $Q_c$ respectively. Since both $T_{sb}$ and $$\frac{\partial T_{solid}}{\partial n}$$

are functions of front moving velocity, which is unknown and needed to be determined, it is still a good approximation at this stage of model development to use heat conduction equation, which is Equation 5, to calculate these two terms.

$$T^* = erfc\left(\frac{x}{2\sqrt{\alpha t}}\right) \tag{5}$$

Where dimensionless temperature $$T^* = \frac{T - T_R}{T_{steam} - T_R},$$

$\alpha$ is the thermal diffusivity and $x=\beta x_b$, $x_b$ is the relative distance between the front 120 location and the location where $T^*=0$. For example, $x_b \cong 3$ m when thermal diffusivity $\alpha$ is equal to 6.0e−7 $m^2/s$.

$\beta$ is introduced herein so $\beta x_b$ can indicate the relative distance between one specific location x with front location $x_0$. So here we call $\beta$ the coefficient beta. In this moving front case, $x_0$ can be viewed as previous front location and x is current front location over the time interval during which bitumen is melted and the front moves on to the next location. Since this distance is really small, a small number of $\beta$ can be used. In a first field case study, $\beta=0.01$ is used with $\beta x_b \cong 3$ cm.

$$\text{Hence, } T_{sb} = T_x = (T_{steam} - T_R)erfc\left(\frac{\beta x_b}{2\sqrt{\alpha t}}\right) + T_R \tag{6}$$

Similarly, $$\frac{\partial T_{solid}}{\partial n}$$

in Eq. (4) can be approximately calculated using the slope of Equation 5 when the location is really close to front location. That is $$\frac{\partial T}{\partial x} = (T_{steam} - T_R)\frac{\partial T^*}{\partial x} = -(T_{steam} - T_R)\frac{2}{\sqrt{\pi}}e^{-\left(\frac{x}{2\sqrt{\alpha t}}\right)^2}\frac{1}{2\sqrt{\alpha t}} \tag{7}$$

$$\frac{\partial T_{solid}}{\partial n} = \frac{\partial T}{\partial x}\bigg|_{x=0} = -(T_{steam} - T_R)\frac{1}{\sqrt{\pi\alpha t}} \tag{8}$$

Substituting Eqs. (6) and (8) into Eq. (4) leads to $$\left[\rho c_p T_{steam} + L\rho - (\rho c_p)_{solid}\left(T_{steam} - (T_{steam} - T_R)erfc\left(\frac{\beta x_b}{2\sqrt{\alpha t}}\right) - T_R\right)\right]V = k_{solid}(T_{steam} - T_R)\frac{1}{\sqrt{\pi\alpha t}} + Q_c$$

which may be referred to as Equation 10.

After re-arrangement, Equation 10 becomes:

$$\left[\rho c_p T_{steam} + L\rho - (\rho c_p)_{solid}\left((T_{steam} - T_R)erf\left(\frac{\beta x_b}{2\sqrt{\alpha t}}\right)\right)\right]V = k_{solid}(T_{steam} - T_R)\frac{1}{\sqrt{\pi\alpha t}} + Q_c$$

which may be referred to as Equation 11.

Therefore, the front moving velocity can be written as:

$$V = \frac{k_{solid}(T_{steam} - T_R)\frac{1}{\sqrt{\pi\alpha t}} + Q_c}{\rho c_p T_{steam} + L\rho - (\rho c_p)_{solid}(T_{steam} - T_R)erf\left(\frac{\beta x_b}{2\sqrt{\alpha t}}\right)} \tag{12}$$

The units on Equation 12 are shown as follows:

$$V = \frac{\frac{[H]}{[L]\cdot[t]\cdot[T]}[T]\frac{1}{[L]^2[t]^{-1}[t]} + \frac{[H]}{[L]^2[t]}}{\frac{[M]}{[L]^3}\left(\frac{[H]}{[M]\cdot[T]}[T] + \frac{[H]}{[M]} - \frac{[H]}{[M]\cdot[T]}[T]\right)} = \frac{\frac{[H]}{[L]^2[t]}}{\frac{[H]}{[L]^3}} = \frac{[L]}{[t]}$$

Up to now, there is still one unknown in Equation 12, which is convective hear flux ahead of moving front $Q_c$.

Determination of this $Q_c$ will involve many other mechanisms, like steam fingering, dilation, channeling, which are functions of porosity, permeability as well as geomechanical properties of bitumen and rock, like Young's modulus, cohesion and so on. And these parameters are also dependent on locations within a heterogeneous formation. In this current version of model, we assume that the convective heat flux at one specific location is $\gamma$ times of conductive heat flux ahead of front location. So this will change with location. Hence, the final equation for front velocity is expressed as $$V = \frac{k_{solid}(T_{steam} - T_R)\frac{1}{\sqrt{\pi\alpha t}}(1+\gamma)}{\rho c_p T_{steam} + L\rho - (\rho c_p)_{solid}(T_{steam} - T_R)erf\left(\frac{\beta x_b}{2\sqrt{\alpha t}}\right)} \tag{13}$$

The value of γ can be obtained by matching front location based on calculated velocity with field observation well data. After that, prediction can be made with this matched value of γ.

The following examples of certain embodiments of the invention are given. Each example is provided by way of explanation of the invention, one of many embodiments of the invention, and the following examples should not be read to limit, or define, the scope of the invention.

Example 1

Figure 5:
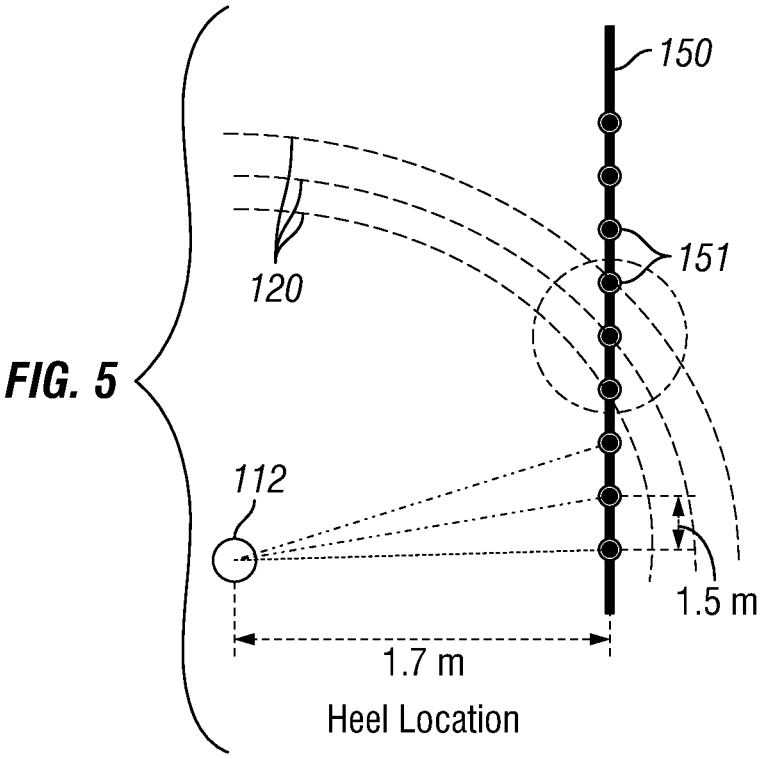
FIG. 5 is a diagram showing the progression of the steam front intersecting sensors in an observation for an example well at the heel locations.
Figure 6:
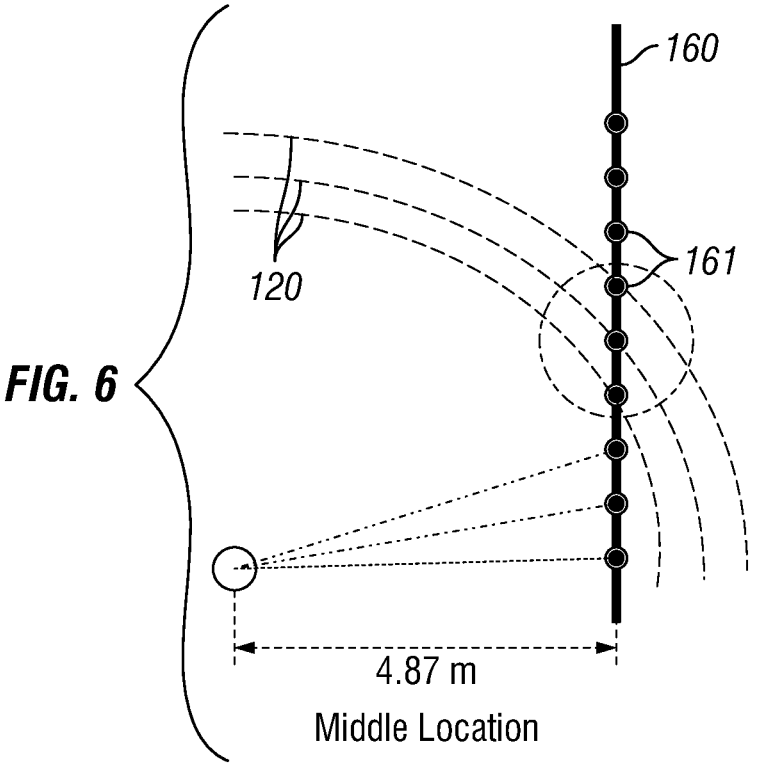
FIG. 6 is a diagram showing the progression of the steam front intersecting sensors in an observation for an example well at the middle location.

FIGS. 5 and 6 show the schematics of two observation wells located beside a horizontal well. In FIG. 5, the first observation well 150 is located at the heel location near where the vertical well turns horizontal and in FIG. 6, the second observation well 160 is located at the middle location of horizontal well length. Fiber optic sensors 151 and 161 were installed on each observation well every 1.5 meters vertically from above the depth of injector to record the temperature. Once the temperature at a fiber optic sensor 151 or 161 reaches steam saturation temperature, we can infer that steam chamber front has arrived at this location. And the front location is calculated as the distance in radial direction between injector 112 and the fiber optic sensor 151 or 161. In the following table are the input parameters for Equation 13 for Example 1:

| $T_R$ (deg C.) | $T_{steam}$ (deg C.) | $\rho_{steam}$ (kg/m$^3$) | L (J/kg) | $c_p$ (J/(kg · K)) | α (m$^2$/s) | $k_{solid}$ (J/m · s · K) | $(\rho C_p)_{solid}$ (J/(m$^3$ · K)) |
|---|---|---|---|---|---|---|---|
| 10 | 250 | 19.9559 | 1.71543e6 | 3772.41 | 6.0e−7 | 0.154 | 2.0e+6 |

Figure 7:
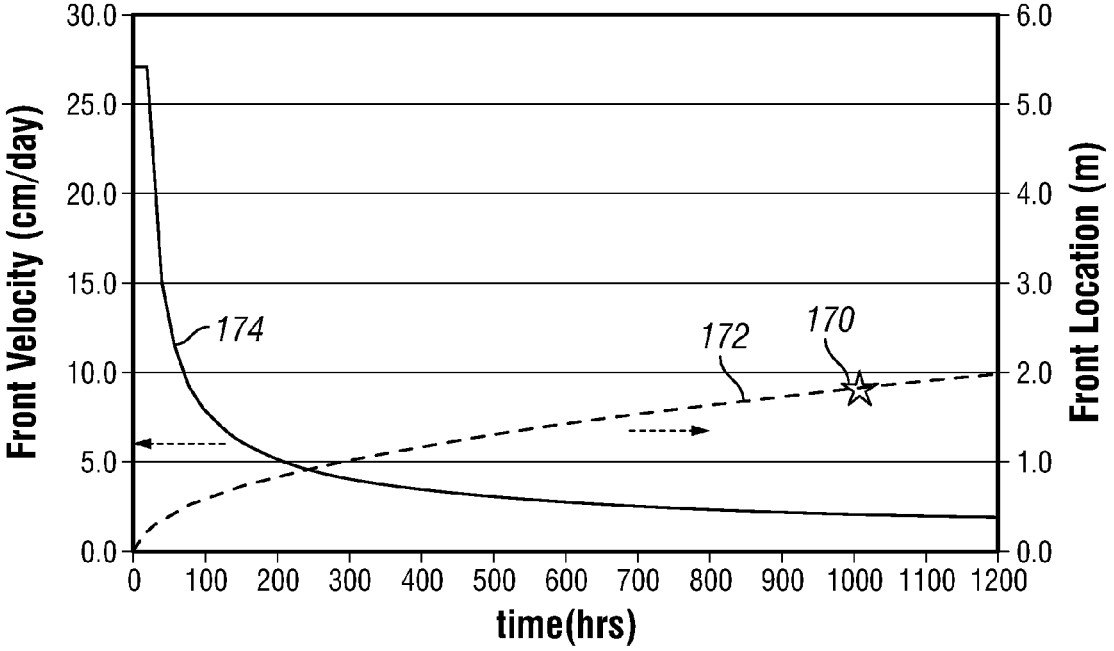
FIG. 7 is a chart showing the first data point from the example well for the progression of the steam front at the heel location, which was used as history match data to get the value of $\gamma$ at the heel location.
Figure 8:
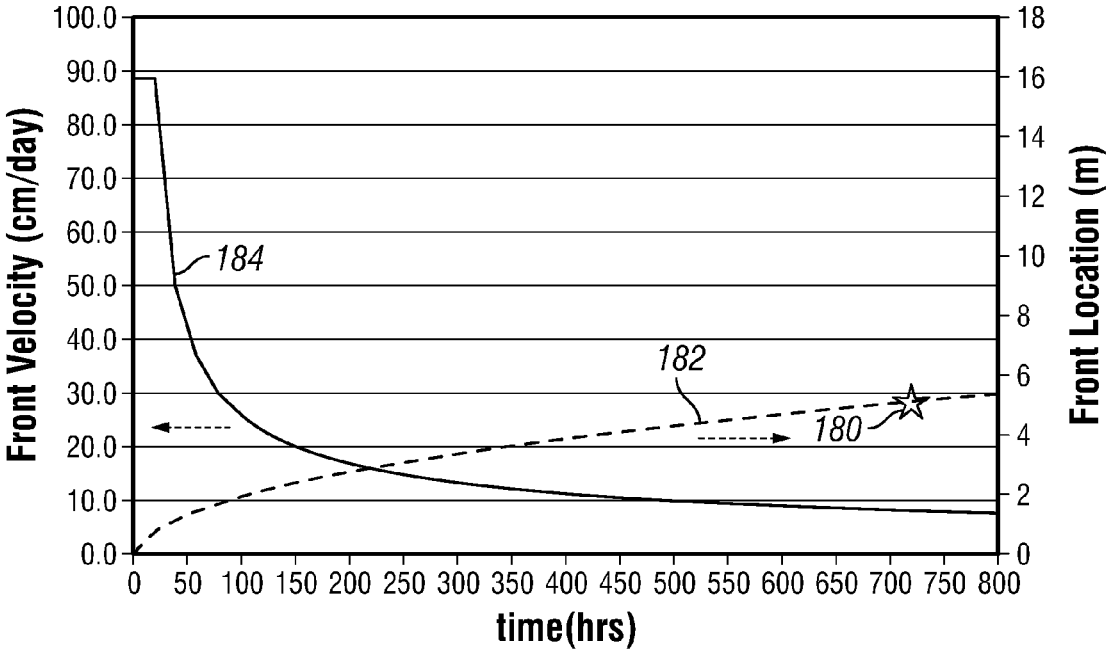
FIG. 8 is a chart showing the first data point from the example well for the progression of the steam front at the middle location, which was used as history match data to get the value of $\gamma$ at the middle location.

As stated previously, the unknown parameter γ in the analytical model in Equation 13 needs to be determined before calculation. And this parameter accounts for the relative amount of convective heat flux to conductive heat flux ahead of front 120. One of the most important mechanisms related to γ is the phenomena of steam fingering and steam channeling due to geomechanical dilation. So, quantifying this convective heat flux using analytical model is extremely difficult. Since γ is based on functions of permeability and porosity, it will depend on the location being investigated. Currently, this is determined by history matching with early temperature history of observation wells such as 150 and 160. FIG. 7 shows the matching results, in which the star 170 refers to first recorded field location data for the steam chamber 110 at the heel location, while line 172 denotes the calculated front location based on calculated front velocity shown as line 174. FIG. 8 shows the matching results for the middle location for the steam chamber 110, in which the star 180 refers to first recorded field location data while line 182 denotes the calculated front location based on calculated front velocity shown as line 184. Based on history matching results, parameter γ are calculated to be 0.25 and 2.0 for the heel location and middle location where observation wells 150 and 160 are located, respectively, which means that the convective heat flux is 25% and 200% of conductive heat flux ahead of steam chamber front location for these two wells 150 and 160, respectively.

Figure 9:
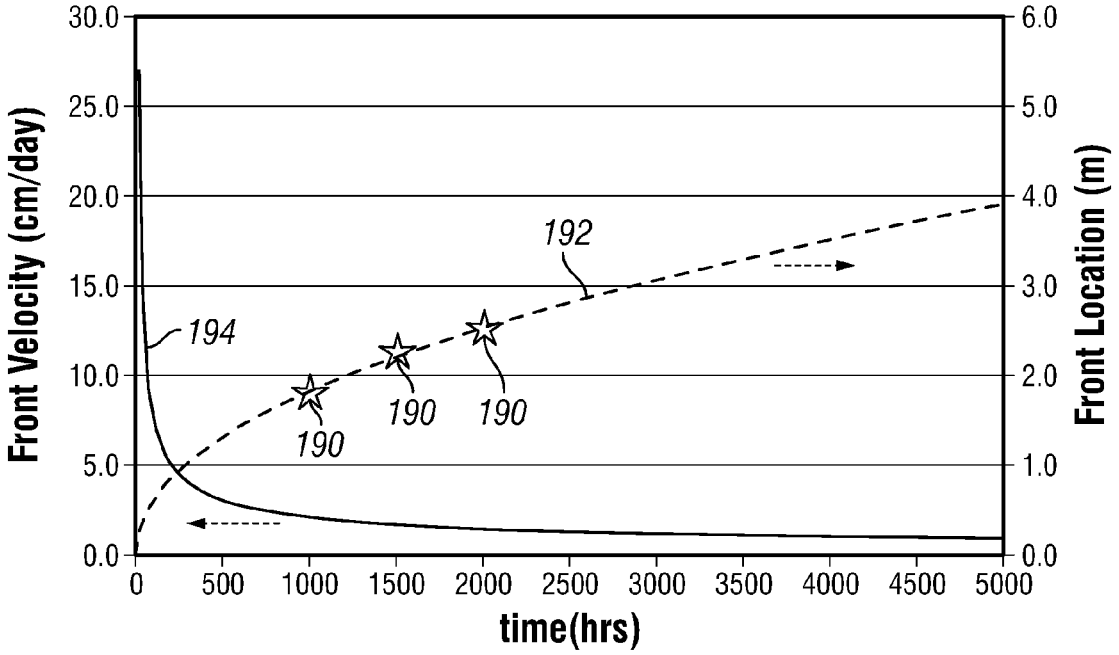
FIG. 9 is a chart showing data points from the example well plotted against the interpretation for the progression of the steam front at the heel location.
Figure 10:
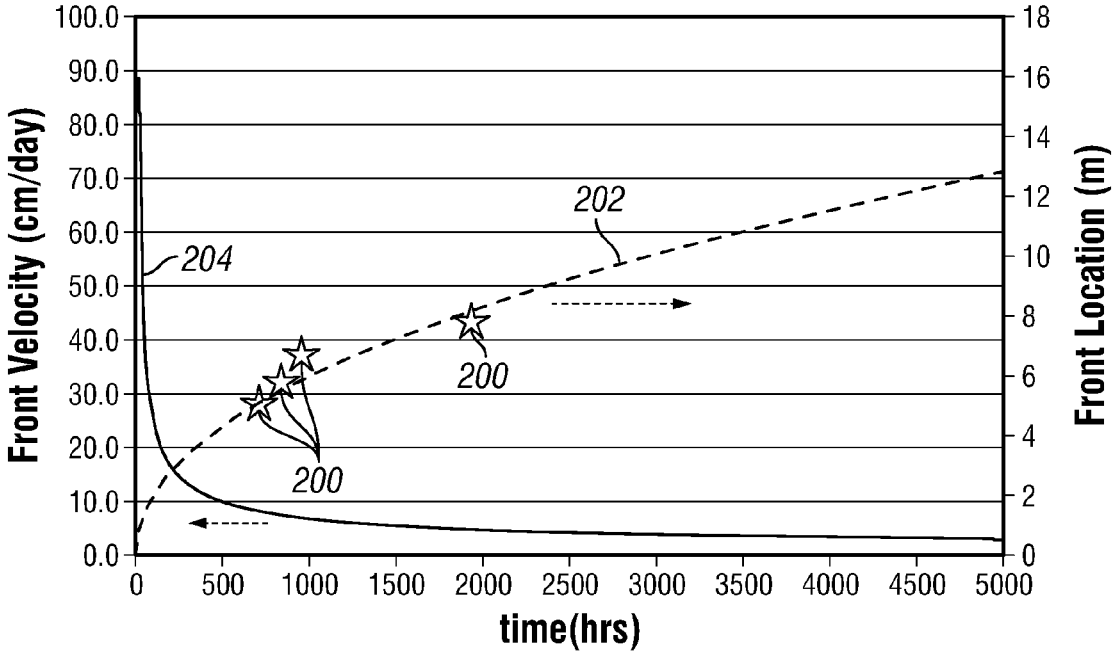
FIG. 10 is a chart showing data points from the example well plotted against the interpretation for the progression of the steam front at the middle location.

Once γ is determined, the developed model was used to predict the location of the steam chamber front 120 as shown in FIGS. 9 and 10 for the heel location and middle location. The fiber optic sensors 151 and 161 in the observation wells 150 and 160 provide accurate time indications for the front as indicated by the stars 190 and 200. The stars 190 and 200 are in good agreement with the predicted progression of the steam front 120 and the speed or velocity of the expanding steam front 120 for both observation wells.

With the information provided by the model for steam front expansion in a SAGD well, an operator could also be better equipped to develop an optimization plan to coordinate the progression of the steam chambers at different locations along the long SAGD wellbore such that the higher conformance factor could be achieved. The conformance factor is described as the degree of evenly production along the wellbore. It is a critical parameter in estimating the efficiency of producing bitumen along the long SAGD wellbore, subsequently the ultimate recovery factor along the wellbore. One example could be utilizing some means to deliver more steam in the areas where steam chamber progressions are predicted to be smaller than those in their proximities and vice versa.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for producing hydrocarbons from a steam assisted gravity drainage formation comprising the steps of:

a) installing a steam injector pipe into the ground to have a horizontal run through a hydrocarbon bearing formation;

b) installing a production pipe into the ground to have a horizontal run through the hydrocarbon bearing formation and being arranged below the steam injector pipe;

c) delivering steam into the steam injector pipe to heat the hydrocarbon formation for reducing viscosity of the hydrocarbons and create a steam chamber as hydrocarbons with reduced viscosity drain from the steam chamber within the hydrocarbon formation where a steam chamber front defines a boundary of the steam chamber from the hydrocarbons that are yet to be sufficiently heated to drain from the steam chamber;

d) producing the hydrocarbons from the hydrocarbon formation to the surface through the production pipe; and e) adjusting rate at which the steam is delivered based upon a model of steam front velocity through the hydrocarbon formation assuming a shape of the steam chamber to be pseudo-radial around the steam chamber such that the steam front is located at a common distance from the steam injector pipe from 20 degrees to 70 degrees from the horizontal on either side of the steam injector pipe.

2. The process for producing hydrocarbons from a steam assisted gravity drainage formation according to claim 1 wherein the step of adjusting the rate at which the steam is delivered utilizes at least one observation well with a plurality of fiber optic sensors to determine the times at which the steam front location has progressed to known distances from the steam injector pipe.

3. The process for producing hydrocarbons from a steam assisted gravity drainage formation according to claim 1 wherein the step of adjusting the rate at which the steam is delivered utilizes a model for the velocity of the expanding front of the steam chamber where the velocity is determined using the heat conductivity of rock formation, the initial temperature of the rock formation, the thermal diffusivity of rock formation, the density of steam, the convective heat flux coefficient and the volumetric heat capacity of the rock formation.

4. The process for producing hydrocarbons from a steam assisted gravity drainage formation according to claim 1 wherein the step of adjusting the rate at which the steam is delivered utilizes a model for the velocity of the expanding front of the steam chamber where the velocity V is determined as follows:

$$V = \frac{k_{solid}(T_{steam} - T_R)\frac{1}{\sqrt{\pi\alpha t}}(1+\gamma)}{\rho c_p T_{steam} + L\rho - (\rho c_p)_{solid}(T_{steam} - T_R)erf\left(\frac{\beta x_b}{2\sqrt{\alpha t}}\right)}$$

where $k_{solid}$ is the heat conductivity of rock formation; $T_{steam}$ is temperature of the steam; $T_R$ is the initial temperature of the rock formation; $\alpha$ is thermal diffusivity of rock formation; $\gamma$ is convective heat flux coefficient; $\beta$ is coefficient beta; and $\rho$ is the density of steam and $(\rho c_p)_{solid}$ is the volumetric heat capacity of rock formation.

5. The process for producing hydrocarbons from a steam assisted gravity drainage formation according to claim 1 wherein the step of adjusting the rate at which the steam is delivered utilizes at least one observation well with a plurality of temperature sensors to determine the times at which the steam front location has progressed to known distances from the steam injector pipe.

6. A process for producing hydrocarbons, comprising:

predicting a steam front velocity through a hydrocarbon formation assuming a shape of a steam chamber to be pseudo-radial around the steam chamber such that the steam front is located at a common distance from a steam injector pipe from 20 degrees to 70 degrees from a horizontal on either side of the steam injector pipe, wherein the predicting is based on a model where the velocity V is determined as follows:

$$V = \frac{k_{solid}(T_{steam} - T_R)\frac{1}{\sqrt{\pi\alpha t}}(1+\gamma)}{\rho c_p T_{steam} + L\rho - (\rho c_p)_{solid}(T_{steam} - T_R)erf\left(\frac{\beta x_b}{2\sqrt{\alpha t}}\right)}$$

where $k_{solid}$ is the heat conductivity of rock formation; $T_{steam}$ is temperature of the steam; $T_R$ is the initial temperature of the rock formation; $\alpha$ is thermal diffusivity of rock formation; $\gamma$ is convective heat flux coefficient; $\beta$ is coefficient beta; and $\rho$ is the density of steam and $(\rho c_p)_{solid}$ is the volumetric heat capacity of rock formation.

7. The process for producing hydrocarbons according to claim 6, wherein the predicting utilizes at least one observation well with a plurality of temperature sensors to determine times at which the steam front location has progressed to known distances from the steam injector pipe.

* * * * *